US005360433A

United States Patent [19]

Medl

[11] Patent Number: 5,360,433

[45] Date of Patent: Nov. 1, 1994

[54] TEAT KNIFE

[75] Inventor: Maximilian Medl, Babenhausen, Germany

[73] Assignee: Franz Schirling, Baubenhausen, Germany

[21] Appl. No.: 193,604

[22] Filed: Feb. 7, 1994

Related U.S. Application Data

[63] Continuation of Ser. No. 919,259, Jul. 27, 1992, abandoned.

[30] Foreign Application Priority Data

Jul. 25, 1991 [DE] Germany ..... 9109210[U]
Apr. 2, 1992 [EP] European Pat. Off. ..... 92105681.8

[51] Int. Cl.[5] ..... A61D 1/02

[52] U.S. Cl. ..... 606/159; 606/167; 606/170; 606/172

[56] References Cited

U.S. PATENT DOCUMENTS 4,672,964 6/1987 Dee et al. ..... 606/167
4,730,394 3/1988 Sonner, Jr. ..... 30/155
5,116,351 5/1992 Frassetti ..... 606/167

FOREIGN PATENT DOCUMENTS 2330551 1/1975 Germany ..... 606/167
698501 10/1953 United Kingdom .
1150232 4/1969 United Kingdom .

*Primary Examiner*—John D. Yasko
*Assistant Examiner*—N. Kent Gring
*Attorney, Agent, or Firm*—Stevens, Davis, Miller & Mosher

[57] ABSTRACT

The proposal relates to a teat knife with a base element (2), a knife sheath (5), and a knife (9) with adjustable swivel angle. The teat knife is characterized in that the knife (9) is constructed as an angle knife with a cutting arm (8) and an operating arm (10) and that a spring (14) which presses the angle knife (9) into its resting position is provided. The teat knife has the advantage that it allows for varying the incision depth in a very simple manner, especially during the cutting process.

24 Claims, 3 Drawing Sheets

TEAT KNIFE

This application is a continuation application of application Ser. No. 07/919,259, filed Jul. 27, 1992, now abandoned.

The invention relates to a teat knife comprising a base element, a knife sheath, and a knife with adjustable swivel angle.

At times, dairy cows are hard to milk, sometimes due to a hard udder. The cause of this is for instance scarring of the milk duct of the affected teat due to injury.

Various methods and instruments are used to treat such disorders. In addition to a stretching of the milk duct, surgical treatment is indicated especially in cases of severe scarring. In the process, one to four vertical incisions are made in the milk duct, i.e. from top to bottom. If the scarring location has been clearly located in the milk duct, the incision should be made through the scarring in the milk duct.

In addition to simple stretching of the milk duct, it is also possible to remove the scar tissue over a wide area using special instruments. However, during this process, the mucous membrane that is necessary as protection against external infections is removed from the milk duct. For this reason, the aforementioned application of vertical incisions is more advantageous since they preserve the mucous membrane. In addition, the vertical incisions have a tendency to heal well.

The type of incision from the top to the bottom requires that the teat knife is constructed in such a way that it maybe inserted into the milk duct with protected incision blade and is only swiveled out of its knife sheath once it is in place. The so-called "Danish double knife" functions according to this principle. The latter is handled in such a way that prior to insertion of the knife into the milk duct, the swivel angle of the knife blade and thus the incision depth is set with a screw mechanism. The knife blade is then swivelled back and the knife is inserted into the milk duct. There, the knife blade is swiveled out until it reaches the previously set swivel angle so that the incision may be performed.

But this known knife has the disadvantage that the incision depth cannot be readjusted during cutting. This means that the incision depth necessarily remains essentially constant over the entire length of the incision.

Sometimes it may also be desirable to replace only the cutting part of the teat knife or to remove it entirely from the knife sheath for cleaning. This is not possible with conventional teat knifes.

The invention has the task of proposing a teat knife which makes it possible to change the cutting depth in a very simple manner during its operation, especially during the cutting process. If so required, the teat knife also shall be constructed so that the cutting part is easily removed, e.g. for replacing a dull cutting edge or for a thorough cleaning of the teat knife.

The invention solves this task with a teat knife of the initially mentioned type which is characterized in that the knife is constructed as an angle knife with a cutting arm and an operating arm, and that a spring is provided which presses the angle knife into its resting position.

The teat knife according to the invention for the first time permits controlled cutting in the milk duct of a teat. The cutting depth may be changed at any time by varying pressure on the operating arm of the angle knife of the teat knife, and thus may be specifically adapted to the treatment of the scars to be cut. This avoids both unnecessarily deep and excessively long incisions. If needed, even several short incisions may be placed consecutively in one cutting direction. Since beginning and end of the cutting process as well as cutting depth are controlled by way of a lever effect caused by corresponding finger pressure on the operating part of the angle knife, the incisions may be placed very strategically in the milk duct without injuring its base.

The teat knife according to the invention is preferably equipped with an adjustable stop mechanism which limits the swivel angle of the angle knife. This limits the maximum incision depth and prevents that the cut is unintentionally made too deep. This provides the user with a high degree of operational safety during use and ensures a great measure of consideration for the treated animal.

A stop mechanism consisting of a cylinder which turns axially in the base element and which has stop slots of various lengths was found to be advantageous. This construction makes it possible to select the maximum incision depth which is suitable in a particular case from several predetermined incision depths.

It is useful that the teat knife has a blocking mechanism for fixating the stop mechanism in various positions within its rotation range, according to the position of the stop slot. This makes it possible to easily find and fixate the particular selected level of maximum incision depth.

It is preferred that the operating arm of the angle knife carries a scale which correlates with the swivel angle of the angle knife. This construction makes it possible to read the incision depth at any time and to change it, if needed.

According to a preferred type of construction the teat knife is designed so that the angle knife is easily removed. This is achieved by constructing the knife swivel shaft on one side of the angle knife and by equipping the knife sheath at the corresponding side of the knife slot, at the level of the knife swivel shaft, with a radial cavity corresponding to the dimensions of the knife swivel shaft for insertion of the angle knife into the knife sheath and also with locking means for holding the inserted angle knife in its resting and working position. Because the locking means are designed so that the hold may be released again, the angle knife easily may be completely removed from the sheath at any time. A replacing of the angle knife and/or cleaning of the same and the sheath therefore is possible without any problems.

In a special variant the locking mechanism consists of a coil spring as well as an axial cavity which extends from the radial cavity essentially along the longitudinal axis of the sheath, and a locking shoulder. This construction is advantageous because it is simply realized. Due to the pressure of the coil spring on the swivel shaft of the angle knife, the latter is held securely in the corresponding cavity and is also prevented from falling out of the sheath unintentionally by the locking shoulder.

It is especially preferred that the locking shoulder is formed by providing at the corresponding end of the axial cavity, essentially in pressure direction of the coil spring, a basically radial locking cavity for holding the knife swivel shaft. In this way the knife swivel shaft may be locked simply by hanging it into the radial locking cavity.

In a teat knife the knife swivel shaft may be constructed on one or both sides of the angle knife. In the latter case, the sheath has the aforementioned cavities on both sides.

The invention is explained below using two embodiments which are shown schematically in the drawing.

Figure 1:
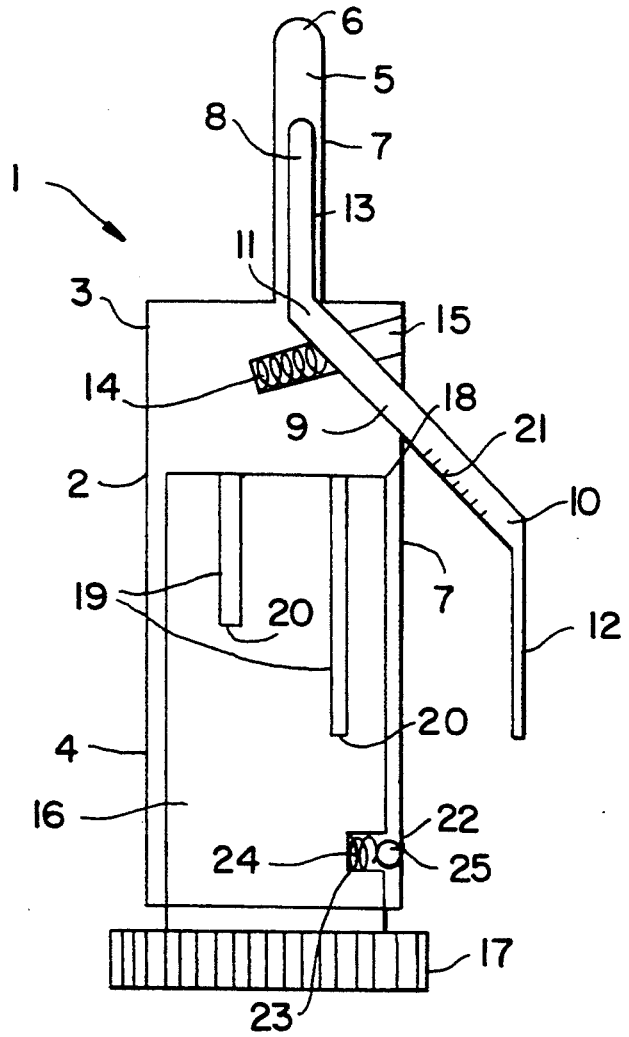
FIG. 1 shows an axial section of a first embodiment of the teat knife.

FIG. 1 shows an axial section of a first embodiment of the teat knife 1. Said teat knife has a cylindrical base element 2 whose top portion 3 is constructed as a full cylinder and whose bottom portion is constructed as a hollow cylinder. The top end 3 carries a knife sheath 5 which is arranged axially. The length of the base element 2 approximately corresponds to the width of a human hand and its diameter is ca. 10 to 15 mm so that it is comfortably and safely handled. The sheath 5 projects ca. 25 mm from the base element 2 and has a diameter of 2 to 3 mm, so that it conforms to the internal diameter of the milk duct in the teat of an average dairy cow. The radial cross-section of the sheath 5 has an oval or circular external circumference with two opposing, beveled peripheral sections. The frontal end 6 of the sheath 5 tapers off towards the end in order not to injure the treated milk duct during insertion of the teat knife 1.

The sheath 5 has on its narrow side an axial knife slot 7 which extends to the bottom over a significant length of the base element 2.

In the resting position of the teat knife 1, a cutting arm 8 of an angle knife 9 is located inside the knife slot 7 of the sheath 5. The angle knife 9 consists of this cutting arm 8 and a operating arm 10 which are connected to each other at a knife swivel shaft 11. The free end of operating arm 10 is equipped with a small pressure plate 12. The angle knife 9 is able to swivel in the knife slot 7 due to its bearing on the knife swivel shaft 11. The cutting arm 8 has a cutting edge 13 which points towards the outside of the sheath 5.

The angle knife 9 is preferably positioned in the swivel shaft 11 of the knife with a screw, so that the angle knife 9 may be replaced by releasing the screw.

In order to keep the angle knife 9 in the regular resting position, as shown in the drawing, where the cutting arm 8 is completely turned into the sheath 5, the top portion 3 of the base element 2 which is constructed as a full cylinder has a coil spring 14. For this purpose, the base element 2 has a spring bore 15 which extends from the outside at an angle to the bottom and whose axis is in the plane of the knife slot 7. A top view onto the knife slot 7 shows that the spring 14 is located behind the operating arm 10 of the angle knife 9 and acts on the latter with a pressure directed towards the resting position of the teat knife 1 shown in the drawing.

The hollow bottom section 4 of the base element 2 holds an essentially cylindrical, coaxially arranged, rotating stop mechanism 16 for the angle knife 9. The stop mechanism 16 projects from the base element 2 with a short axial section and supports a knurling wheel 17 which engages with the stop mechanism and in which the base element 2 may be turned.

The axial length of the stop mechanism 16 inside the base element 2 starts at the knurling wheel and extends past its vertical center. At the same time, the knife slot 7 extends downwards in the base element 2 along a significant length of the stop mechanism 16. In the resting position of the teat knife 1 the operating arm 10 is located only slightly above a top edge 18 of the stop mechanism 16. In this position this top edge 18 thus acts as a stop for the operating arm 10, preventing a swiveling out of the cutting arm 8 of the angle knife 9.

Starting at its top edge 18, the stop mechanism 16 is equipped along its cylindrical circumference with several, e.g. three, radial stop slots 19 of various lengths which extend vertically parallel to the cylinder axis of the stop mechanism 16. The width of the stop slots 19 corresponds approximately to the width of the knife slot 7 in the base element 2. The stop slots 19 may be brought in line with the knife slot 7 by turning the stop mechanism 16 accordingly. If they are not in line, the operating arm 10 of the angle knife cannot be pressed further into the knife slot 7 from its resting position, as mentioned above. But if one of the stop slots 19 is in line with the knife slot 7 of the base element, the operating arm 10 may be pressed into this stop slot 19, thus enabling the swiveling out of the cutting arm 8 of the angle knife 9. The maximum swivel angle which may be achieved hereby depends on the swivel depth of the operating arm 10 into the respective stop slot 19. This swiveling-in depth is determined by the position of the bottom slot end 20 of the stop slot 19. This bottom slot end 20 acts as stop for the operating arm 10.

Alternatively, the top edge 18 of the cylindrical stop mechanism 16 may be constructed as a stop curve, replacing or supplementing the stop slots 19, whereby the incision depth may then be controlled continuously.

In order to be able to preset or read the extent of the swiveling out of cutting arm 8 of the angle knife 9 from the sheath 5, the operating arm 10 is equipped with a scale 21 which correlates with the swiveling-out angle of the cutting arm 8 and thus with the desired incision depth. The scale 21 is read at the point where the operating arm 10 enters the base element 2.

In order to facilitate finding the positions of stop mechanism 16 where one of the stop slots 19 is in line with the knife slot 7 of the base element 2, the base element 2 has a blocking mechanism. It comprises several, e.g. three, radial catch bores 22 in the base element 2. At the same axial level the stop mechanism 16 is equipped with a pocket bore 23. The latter holds a stop spring 24 which presses a stop ball 25 against the selected stop bore 22. The diameter of the stop bore 22 is smaller than that of the stop ball 25.

Figure 2:
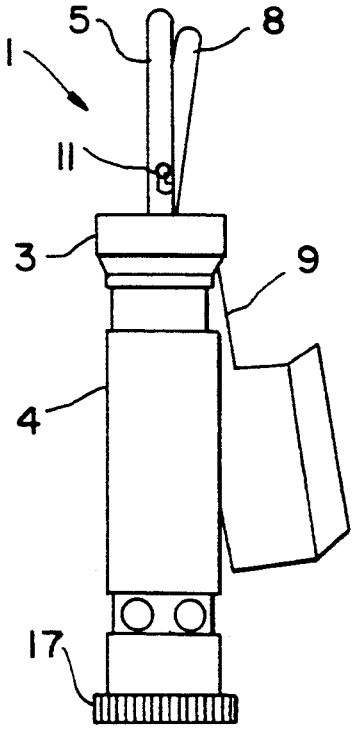
FIG. 2 shows a lateral view of a second embodiment of the teat knife.

FIGS. 2 to 7 show a second embodiment of the teat knife 1. Its functional parts correspond to the construction of the aforementioned first embodiment, except for the connection between sheath 5 and angle knife 9. For this reason only this connection is described below:

FIG. 2 shows a lateral view of the teat knife in which the cutting arm 8 of the angle knife 9 is swiveled outward. The knife swivel shaft 11 is anchored in the bottom part of the sheath 5, as described in more detail below.

Figure 3:
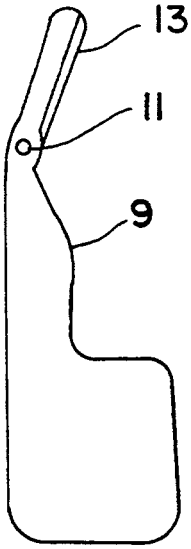
FIG. 3 shows a lateral view of an angle knife removed from the teat knife according to FIG. 2.
Figure 4:
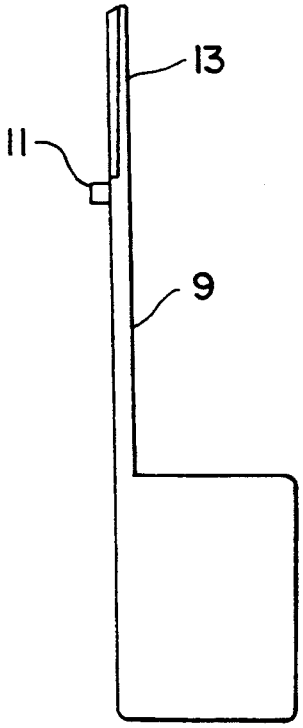
FIG. 4 shows an enlarged view of the angle knife according to FIG. 3, turned sideways by 90°.

According to FIGS. 3 and 4 the angle knife 9 only has one knife swivel shaft 11 on the left side in the viewing direction towards the cutting edge 13.

Figure 5:
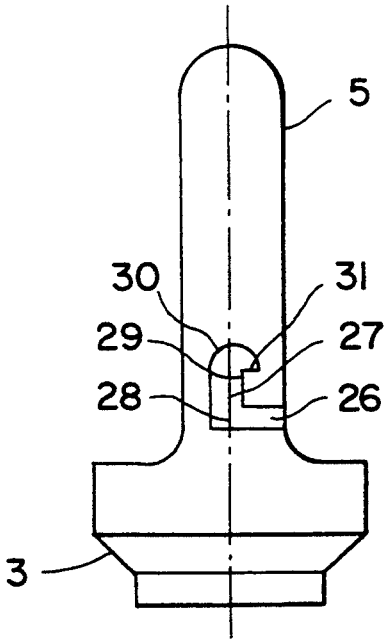
FIG. 5 shows a lateral view of the top portion of the teat knife according to FIG. 2 without the angle knife.
Figure 6:
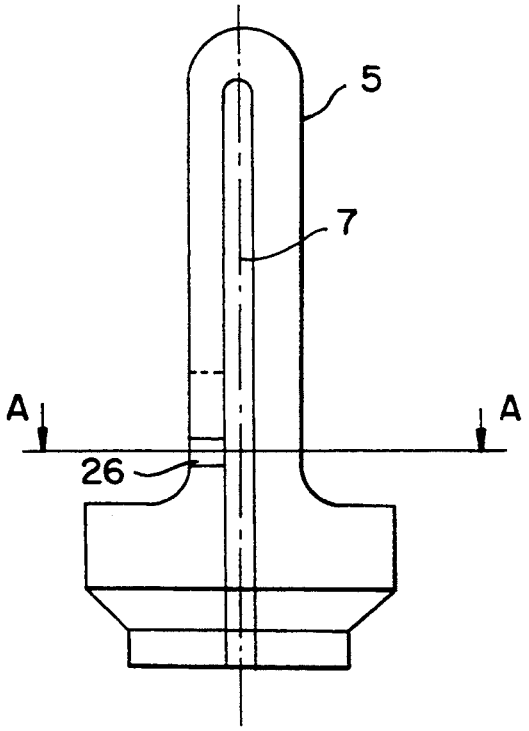
FIG. 6 shows a lateral view of the top portion of the teat knife according to FIG. 5, turned 90° to the left.
Figure 8:
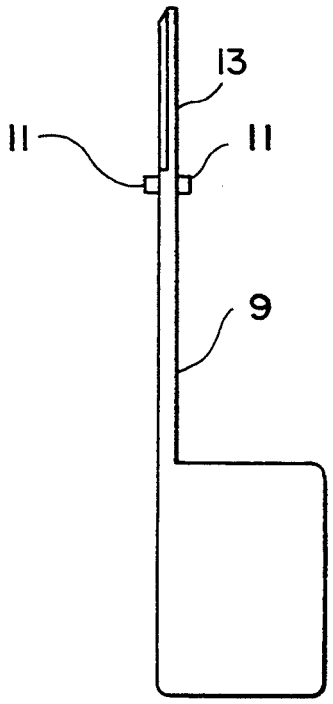
FIG. 8 shows the knife swivel shaft on both sides of the angle knife.

According to FIG. 5 which shows the same lateral view as FIG. 2, but only an enlargement of top portion 3 of the teat knife 1, the angle knife 9 is removed from the sheath 5. The sheath 5 has a radial cavity 26 on the corresponding side, at which the inserted angle knife 9 carries the swivel shaft 11. This cavity corresponds to the dimensions of the knife swivel shaft 11 and allows for inserting the angle knife 9 into the sheath 5. FIG. 6 shows that for this reason the cavity 26 is only located on the left side of the sheath 5, when viewed in the direction of the axial slot 7 of the sheath 5.

The angle knife 9 is anchored in the sheath 5 with locking means. These locking means comprise on the one hand the coil spring 14 which in to FIG. 1 presses the inserted angle knife 9 essentially radially to the outside, and on the other hand an axial cavity 27 which according to FIG. 5 extends as a continuation of the radial cavity 26 from the latter's interior end 28 upwards in the direction of the longitudinal axis of the sheath 5 and ends above a locking shoulder 29.

The locking shoulder 29 is formed by providing at the associated end 30 of the axial cavity 27, essentially in the pressure direction of coil spring 14 (shown only in FIG. 1), an essentially radial locking cavity 31 for holding the knife swivel axis 11. In this way the locking shoulder 29 is created at the transition between axial cavity 27 and radial locking cavity 31. When the angled knife 9 is inside the sheath 5, either in resting or cutting position, the pressure of the coil spring 14 presses the swivel shaft 11 of the knife into the radial locking cavity 31 which then functions as a bearing for the swivel shaft 11.

Figure 7:
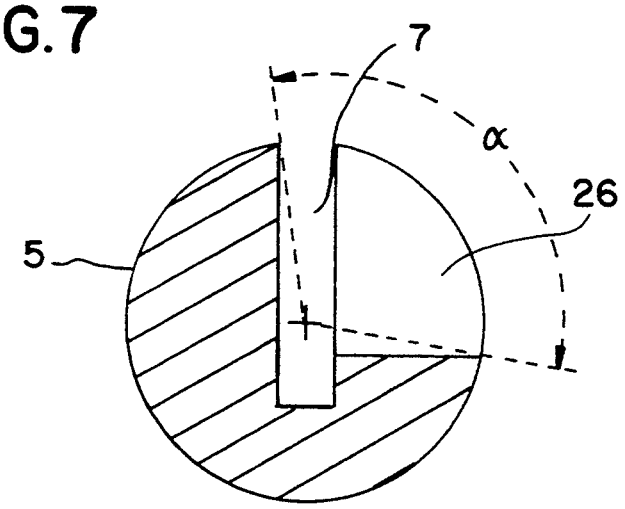
FIG. 7 shows a section according to line AA in FIG. 6.

FIG. 7 shows that the radial cavity 26 extends over a larger angle $\alpha$ of the circumference of the sheath 5 which is shown in FIG. 7 in circular shape for reasons of simplicity. The radial cavity 26 immediately follows the knife slot 7, and together with the latter forms a total cavity which extends over a sector $\alpha$ of the sheath 5 in excess of 90°.

Another possible construction which is not shown in the drawing is essentially identical with the embodiment according to FIGS. 2 to 7. The difference is that the swivel shaft of the knife is constructed on both sides of the angle knife 9, and thus has corresponding cavities 26, 27, 31 on both sides of the knife slot 7, when looking at the knife slot 7.

Suitable materials for the teat knife 1 are different substances, e.g. metals and plastics. The angle knife 9 preferably consists of metal.

Use of the teat knife 1 is described below in reference to the first embodiment according to FIG. 1. First the stop mechanism 16 is positioned in such a way by turning the knurling wheel 17 to the desired locking position that the maximum swiveling-out angle of the cutting arm 8 of the angle knife 9 and thus its maximum incision depth is set with the corresponding stop slot 19. This incision depth may be checked using the scale 21. Then the sheath 5 is inserted into the milk duct of the treated teat, while the teat knife 1 is in resting position. The cutting arm 8 is swiveled out of the sheath 5 by exerting pressure on the operating arm 10. The desired incision is made by pulling the teat knife 1 out of the milk duct. In the process, the incision depth may be varied as desired up to a predetermined maximum value by exerting different pressures on the operating arm 10. It is also possible to make the cut only in a desired section of the milk duct by pressing the hand holding the teat against the milk duct, or to enlarge the incision, if needed.

The second embodiment of the teat knife 1 which is explained in FIGS. 2 to 7 is used in the same way. But this version offers the additional advantage that the angle knife 9 may be very easily completely removed from the sheath 5. For this purpose, a radial pressure in the direction of the longitudinal axis is exerted on the angle knife 9 at the level of the swivel shaft 11 against the pressure of the coil spring 14. This moves the swivel shaft 11 from the radial locking cavity 31 into the axial cavity 27, from where it may be pulled downward past the locking shoulder 29 into the axial cavity 26. From there the swivel shaft 11 and thus the angle knife 9 easily slides out of the sheath 5. In this way it is easy to replace the angle knife 9 with a new one, or clean the angle knife 9 and the knife slot 7. This sequence is reversed for inserting the angle knife 9 into the sheath 5. The angle knife 9 is moved with the swivel shaft 11 through the radial cavity 26 towards the inside, then upward in the axial cavity 27, and then back to the outside again for a short distance above the locking shoulder 29. The pressure of the coil spring 14 then returns the angle knife 9 to its resting or cutting position.

I claim:

1. A teat knife comprising a base element (2), a spring (14) positioned within said base element (2), a knife sheath (5) fixed to said base element (2) with a longitudinal slot (7) therein, and a knife (9) with an adjustable swivel angle within said sheath slot (7), said knife (9) being constructed as an angle knife having a proximal and a distal portion, the distal portion comprising a cutting arm (8), a manually controllable operating arm (10) disposed at an angle to said cutting arm and connecting the operating arm to the distal portion, the distal portion comprising a pressure plate for moving the knife into an exposed cutting position, said spring (14) biasing the operating arm (10) of said angle knife (9) into a resting position wherein said cutting arm (8) is within said sheath (5).

2. The teat knife according to claim 1, including a variable stop mechanism (16) within said base element contacting said operating arm (10) to limit the swivel angle of the angle knife (9).

3. The teat knife according to claim 2, wherein said stop mechanism (16) consists of a cylinder which turns axially in the base element (2) and which has radially directed stop slots (19) of various lengths.

4. The teat knife according to claim 3, including a blocking mechanism (22, 23, 24, 25) on said base element for fixating the stop mechanism (16) in various positions within its rotation range, according to the position of the stop slots (19).

5. The teat knife according to claim 1, wherein said operating arm (10) of the angle knife (9) carries a scale (21) which correlates with the swivel angle of the angle knife (9).

6. The teat knife according to claim 2, wherein said operating arm (10) of the angle knife (9) carries a scale (21) which correlates with the swivel angle of the angle knife (9).

7. The teat knife according to claim 3, wherein said operating arm (10) of the angle knife (9) carries a scale (21) which correlates with the swivel angle of the angle knife (9).

8. The teat knife according to claim 4, wherein said operating arm (10) of the angle knife (9) carries a scale

(21) which correlates with the swivel angle of the angle knife (9).

9. The teat knife according to claim 1, wherein said angle knife (9) has a swivel shaft (11) on one side of the angle knife (9) and said knife sheath (5) has a radial cavity (26) corresponding to the dimensions of the knife swivel shaft (11) communicating with said sheath slot at a level of the knife swivel shaft (11), for insertion of the angle knife (9) into the knife sheath (5) and also locking means within said sheath for holding the inserted angle knife (9) in resting and working position.

10. The teat knife according to claim 2, wherein said angle knife (9) has a swivel shaft (11) on one side of the angle knife (9) and said knife sheath (5) has a radial cavity (26) corresponding to the dimensions of the knife swivel shaft (11) communicating with said sheath slot at a level of the knife swivel shaft (11), for insertion of the angle knife (9) into the knife sheath (5) and also locking means within said sheath for holding the inserted angle knife (9) in resting and working position.

11. The teat knife according to claim 3, wherein said angle knife (9) has a swivel shaft (11) on one side of the angle knife (9) and said knife sheath (5) has a radial cavity (26) corresponding to the dimensions of the knife swivel shaft (11) communicating with said sheath slot at a level of the knife swivel shaft (11), for insertion of the angle knife (9) into the knife sheath (5) and also locking means within said sheath for holding the inserted angle knife (9) in resting and working position.

12. The teat knife according to claim 4, wherein said angle knife (9) has a swivel shaft (11) on one side of the angle knife (9) and said knife sheath (5) has a radial cavity (26) corresponding to the dimensions of the knife swivel shaft (11) communicating with said sheath slot at a level of the knife swivel shaft (11), for insertion of the angle knife (9) into the knife sheath (5) and also locking means within said sheath for holding the inserted angle knife (9) in resting and working position.

13. The teat knife according to claim 5, wherein said angle knife (9) has a swivel shaft (11) on one side of the angle knife (9) and said knife sheath (5) has a radial cavity (26) corresponding to the dimensions of the knife swivel shaft (11) communicating with said sheath slot at a level of the knife swivel shaft (11), for insertion of the angle knife (9) into the knife sheath (5) and also locking means within said sheath for holding the inserted angle knife (9) in resting and working position.

14. The teat knife according to claim 9, wherein said locking means includes an axial cavity (27) in said sheath (5) which extends from the radial cavity (26) essentially along the longitudinal axis of the sheath (5), and a locking shoulder (29) communicating with said axial cavity (27).

15. The teat knife according to claim 10, wherein said locking means includes an axial cavity (27) in said sheath (5) which extends from the radial cavity (26) essentially along the longitudinal axis of the sheath (5), and a locking shoulder (29) communicating with said axial cavity (27).

16. The teat knife according to claim 11, wherein said locking means includes an axial cavity (27) in said sheath (5) which extends from the radial cavity (26) essentially along the longitudinal axis of the sheath (5), and a locking shoulder (29) communicating with said axial cavity (27).

17. The teat knife according to claim 12, wherein said locking means includes an axial cavity (27) in said sheath (5) which extends from the radial cavity (26) essentially along the longitudinal axis of the sheath (5), and a locking shoulder (29) communicating with said axial cavity (27).

18. The teat knife according to claim 13, wherein said locking means includes an axial cavity (27) in said sheath (5) which extends from the radial cavity (26) essentially along the longitudinal axis of the sheath (5), and a locking shoulder (29) communicating with said axial cavity (27).

19. The teat knife according to claim 14, wherein said locking shoulder (29) is formed by providing a basically radial locking cavity (31) at an end (30) of the axial cavity (27), said spring (14) biasing said angle knife (9) in the direction of seating the knife swivel shaft (11) in the radial locking cavity (31).

20. The teat knife according to claim 15, wherein said locking shoulder (29) is formed by providing a basically radial locking cavity (31) at an end (30) of the axial cavity (27), said spring (14) biasing said angle knife (9) in the direction of seating the knife swivel shaft (11) in the radial locking cavity (31).

21. The teat knife according to claim 16, wherein said locking shoulder (29) is formed by providing a basically radial locking cavity (31) at an end (30) of the axial cavity (27), said spring (14) biasing said angle knife (9) in the direction of seating the knife swivel shaft (11) in the radial locking cavity (31).

22. The teat knife according to claim 17, wherein said locking shoulder (29) is formed by providing a basically radial locking cavity (31) at an end (30) of the axial cavity (27), said spring (14) biasing said angle knife (9) in the direction of seating the knife swivel shaft (11) in the radial locking cavity (31).

23. The teat knife according to claim 18, wherein said locking shoulder (29) is formed by providing a basically radial locking cavity (31) at an end (30) of the axial cavity (27), said spring (14) biasing said angle knife (9) in the direction of seating the knife swivel shaft (11) in the radial locking cavity (31).

24. The teat knife according to claim 9, including a knife swivel shaft (11) constructed on both sides of the angle knife (9), and that said sheath (5) accordingly has cavities (26, 27, 31) on both sides of said knife slot (7).

* * * * *